US005307938A

United States Patent [19]

Lillmars

[11] Patent Number: 5,307,938

[45] Date of Patent: May 3, 1994

[54] TREATMENT OF IRON ORE TO INCREASE RECOVERY THROUGH THE USE OF LOW MOLECULAR WEIGHT POLYACRYLATE DISPERSANTS

[76] Inventor: Glenn Lillmars, 30190 Falcon Ave., Stacy, Minn. 55079

[21] Appl. No.: 851,626

[22] Filed: Mar. 16, 1992

[51] Int. Cl.[5] ..... B03B 1/04; B03D 1/008; B03D 1/02

[52] U.S. Cl. ..... 209/167; 209/5; 209/166; 241/16; 241/20; 241/24

[58] Field of Search ..... 209/5, 166, 167, 164; 241/20, 24, 16

[56] References Cited

U.S. PATENT DOCUMENTS

| | | | |
|---|---|---|---|
| 2,740,522 | 4/1956 | Aimone | 209/167 |
| 3,292,780 | 12/1966 | Fromnev | 209/5 |
| 3,397,953 | 8/1968 | Galvin . | |
| 3,418,237 | 12/1968 | Booth . | |
| 3,607,394 | 9/1971 | Germino | 209/167 |
| 3,932,275 | 1/1976 | Mewes . | |
| 4,081,357 | 3/1978 | Werneke | 210/734 |
| 4,090,955 | 5/1978 | Dexter | 209/5 |
| 4,107,028 | 8/1978 | Emmett | 209/164 |
| 4,137,164 | 1/1979 | Cosica et al. . | |
| 4,137,165 | 1/1979 | Cosica et al. . | |
| 4,192,738 | 3/1980 | Colombo | 209/166 |
| 4,274,945 | 6/1981 | Goodman et al. . | |
| 4,282,087 | 8/1981 | Goodman | 209/5 |
| 4,289,613 | 9/1981 | Goodman | 209/167 |
| 4,298,169 | 11/1981 | Iwasaki | 209/5 |
| 4,301,973 | 11/1981 | Lai . | |
| 4,339,331 | 7/1982 | Lim | 209/167 |
| 4,360,425 | 11/1982 | Lim | 209/167 |
| 4,495,367 | 1/1985 | Dammann | 564/208 |
| 4,523,991 | 6/1985 | Meyer | 209/166 |
| 4,569,768 | 2/1986 | McKinley | 210/727 |
| 4,579,944 | 4/1986 | Harvey . | |
| 4,657,666 | 4/1987 | Snook et al. | 209/8 |
| 4,699,712 | 10/1987 | Unger | 209/166 |
| 4,701,264 | 10/1987 | Braun | 209/5 |
| 4,732,667 | 3/1988 | Hellsten et al. | 209/166 |
| 4,745,129 | 5/1988 | Ikari et al. | 514/502 |
| 4,795,578 | 1/1989 | Hellsten . | |
| 4,808,301 | 2/1989 | Hansen | 209/167 |
| 4,830,739 | 5/1989 | Hellsten et al. . | |

FOREIGN PATENT DOCUMENTS

| | | | |
|---|---|---|---|
| 293534 | 12/1988 | European Pat. Off. | 241/16 |

*Primary Examiner*—Thomas M. Lithgow

[57] ABSTRACT

The described invention relates to the processing of iron ore, particularly taconite ore. In particular, the invention relates to the separation of the iron containing component from the silicious and other gangue components such as phosphorus compounds in low grade iron ore. Typically, the separation is accomplished by a flotation process to remove the gangue to recover the iron component.

60 Claims, No Drawings

TREATMENT OF IRON ORE TO INCREASE RECOVERY THROUGH THE USE OF LOW MOLECULAR WEIGHT POLYACRYLATE DISPERSANTS

BACKGROUND OF THE INVENTION

1. Field of the Invention

This invention relates to the production of iron oxide, particularly from low grade iron ore bodies, such as taconite. The iron oxide is recovered from an aqueous slurry of the ore. This invention applies particularly to the processing of fine grained and/or earthy iron ore deposits.

2. Description of the Art Practices

Iron ore is obtained from deposits referred to as either high or low grade deposits. The present invention is in the processing of low grade iron ore. Low grade iron ore is typically referred to as taconite ore, which is an oxidized form of the ferrous component in the ore body. Taconite, in the United States, refers to two primary iron ore types, magnetite and hematite. Magnetite is the lesser oxidized form of the ferrous component and has the chemical formula $Fe_3O_4C$. Hematite ore is the more oxidized version of taconite, and has the chemical formula $Fe_2O_3$.

Taconite ore, in its several forms, occurs in sedimentary deposits, usually exposed by glacial activity, and exists in various degrees of oxidation, hydration, and fineness of grain. Hematite normally comprises the upper horizons of the iron ore body where more exposure to the atmosphere and weathering has caused a greater degree of oxidation and hydration than magnetite in the lower horizons (strata). In some cases, the taconite may be oxidized to the depth of the ore body.

There is a further significant difference between magnetite and hematite ore. Magnetite, as the name suggests, exhibits magnetic properties. The presence of strong magnetic properties in magnetite ore, and not in hematite ore, allows the economical use of magnetic separation in iron ore processing to recover magnetite, but not hematite.

For the foregoing reasons, magnetite was the ore of preference from taconite because this ore could be recovered economically. In the mining industry, two properties are important when processing ore. The first is recovery, or the amount of desired mineral which may be obtained from the starting ore body. Secondly, the grade of the ore refers to the purity of the mineral concentrate obtained. Both recovery and grade are extremely important as to the economics and the marketability of the finished product.

On the Mesabi iron range, magnetite has been the ore of preference because of the ease of recovery by magnetic methods. Hematite is stripped and stockpiled because economical recovery methods have not been available. Thus, it is highly desirable to process hematite ores already stockpiled in vast quantities.

U.S. Pat. No. 4,081,357 issued to Werneke on Mar. 28, 1978 discusses the recovery of iron ores. Mewes, et al, in U.S. Pat. No. 3,932,275 issued Jan. 13, 1976, describes a treatment for the recovery of mineral slimes. The treatment of an iron concentrate slurry to improve filtration is disclosed by Emmett et al in U.S. Pat. No. 4,107.028 issued Aug. 15, 1978.

A process for clarifying iron ore slimes is disclosed in U.S. Pat. No. 4,137,164 issued to Coscia et al on Jan. 30, 1979. A similar process for clarifying raw water is disclosed in U.S. Pat. No. 4,137,165 also to Coscia et al Jan. 30, 1979.

A process for iron ore benefication by selective flocculation is disclosed by Goodman et al in U.S. Pat. No. 4,274,945 issued Jun. 23, 1981. A further process describing the selective flocculation, magnetic separation and floatation of ores is described by Iwasaki in U.S. Pat. No. 4,298,169 issued Nov. 3, 1981.

Lai, in U.S. Pat. No. 4,301,973 issued Nov. 24, 1981 describes the use of floatation agents for the benefication of iron ore. The use of cross linked starches as depressants in mineral ore floatation is described by Lim in U.S. Pat. No. 4,339,331 issued Jul. 13, 1982.

A process for the froth floatation benefication of iron minerals through iron ores is described in U.S. Pat. No. 4,830,739 issued May 16, 1989 to Hellstem et al. Similar disclosures are found in U.S. Pat. No. 4,795,578 issued Jan. 3, 1989, also to Hellston et al. Still further disclosures on the processing of froth floatation benefication of iron ore minerals from iron ores is found in U.S. Pat. No. 4,732,667 issued Mar. 22, 1988 to Hellston et al.

The use of chemically active aqueous solutions or solid substance containing divalent iron ions is disclosed by Ikari et al in U.S. Pat. No. 4,745,129 issued May 17, 1988. An ore dressing for copper ore using various polymers is described in U.S. Pat. No. 4,699,712 issued Oct. 13, 1987 to Unger. A process for using polymers to remove gangue in gold recovery is described in U.S. Pat. No. 4,657,666 issued Apr. 7, 1987 to Snook et al.

Starch which has been modified to allow its use in the processing of ores is described in U.S. Pat. No. 4,579,944 to Harvey issued Apr. 1, 1986. The flocculation of suspended solids from aqueous media is described in U.S. Pat. No. 4,569,768 issued Feb. 11, 1986. Similarly, U.S. Pat. No. 4,523,991 issued to Meyer on Jun. 18, 1985, describes carrier particles for the froth flotation of fine ores.

The use of high charge density, cationic methacrylamide based monomers and their polymers as being useful in mining, is described in U.S. Pat. No. 4,495,367 issued to Dammann Jan. 22, 1985. A general digest if mineral dressing practices is found in *The Handbook of Mineral Dressing* by Taggart, John Wiley & Sons, Inc., copyright 1945.

Throughout the specification and claims, percentages and ratios are by weight and temperatures are in degrees Celsius unless otherwise indicated. Ranges and ratios herein may be combined. To the extent that any reference cited herein is relevant to the present invention it is herein incorporated by reference.

SUMMARY OF THE INVENTION

The premise of the present invention is the use of polyacrylate polymers, homopolymers and copolymers, as a dispersant for iron ore pulps to significantly increase the recovery of iron oxide in deslime, flotation or other separation processes requiring a highly dispersed pulp.

The present invention describes a process for treating an iron containing ore slurry including the steps of contacting an iron containing ore slurry with a dispersant polymer or copolymer containing at least one acrylic functional group, and grinding the iron containing ore slurry to a desired particle size and thereafter decanting or floating off the gangue while retaining iron oxide in the precipitate.

A further embodiment of the invention is a method for separating an iron containing component from a silicate component including the steps of forming an aqueous mixture of the iron containing component and the silicate component, adding thereto a dispersant polymer or copolymer containing an acrylic functional group, and separating the silicate component to overflow while retaining the iron component in the underflow.

Yet a further embodiment of the invention is a method for separating an iron containing component from a phosphorous component including the steps of forming an aqueous mixture of the iron containing component and the phosphorous component, adding thereto a dispersant polymer or copolymer containing an acrylic functional group, and separating the phosphorous component by an overflow while retaining the iron component in the underflow.

This invention is also directed to a method for separating hematite from a member selected from the group consisting of a silicate component and a phosphorous containing component including the steps of grinding a taconite ore body in the presence of water to obtain an aqueous mixture of hematite adding thereto a dispersant polymer or copolymer containing an acrylic functional group, and separating the hematite component from the resultant gangue.

Also described herein is a composition of matter comprising:

A. a source of taconite ore,

B. a dispersant polymer or copolymer containing an acrylic functional group, and C. water.

DETAILED DESCRIPTION OF THE INVENTION

The present invention proceeds according to existing processing within iron mines, in particular, the mines in the United States of America which process magnetite or hematite types ores. Concentration or benefication are those operations which process a particular ferrous ore to recover a specific form of the ferrous mineral to a marketable grade.

Ferrous (taconite) ore bodies which are useful in the present invention are those, for example located on the Mesabi and Marquette ranges. In particular, mines and mine concentrator operations to which the present invention is suited include the Tilden mine. The invention is also applicable to iron ore processing in Tasmania, India, Canada, Australia, China, Norway, Sweden, Finland, the former Soviet Union, the Korean Peninsula, Brazil, Venezuela, Liberia, Mauritania, South Africa, and France.

The simplicity of the present invention is that the conventional hematite processing techniques in the mine concentrators may be employed with little or no modification. Moreover, in mines which utilize a magnetic separator for the processing of magnetite ore, that equipment need not be replaced as it will not necessarily be utilized in the present invention. The techniques of the present invention may also be used with magnetic ores to enhance grade and recovery.

A typical operation for the recovery of hematite and magnetite is described below. The recovery of hematite begins with its mining from the ground, crushing, transportation and the storage of the crude ore at the concentrator plant. The crude ore is typically treated with caustic soda, a silicate dispersant (sodium silicate typically) and glassy phosphates. The treatment with the foregoing chemicals is to disperse the iron ore pulp and to allow selective flocculation.

Typically, chemically treated ore is ground and classified to a size of 0.1 to 500 microns, e.g. 325 mesh or lower. This process includes primary and secondary grinding, cone crushing, screening and cycloning. The cyclone overflow is fed to a starch flocculant conditioner. The underflow from the cyclone is fed to a pebble mill for further grinding.

The conditioned cyclone overflow with the starch flocculant therein is, in the current method, fed to a deslime thickener. The deslime thickener feed is typically at less than about 15% solids and has a pH of about 11. The present invention allows the pH to be reduced substantially to about 8 to 10.5, preferably about 8.5 to 10.0. Thus, in the present invention, an ambient pH of about 8 may be effectively utilized. However, operating at a higher pH may allow a greater recovery of iron oxide.

The deslime thickener operates as follows. The dispersed gangue is decanted off the top of the deslime thickener while the iron component is selectively flocculated such as with starch.

In the present invention, the entire process of deslime thickening is enhanced by the addition of the acrylic polymer or copolymer which effectively disperses the pulp to avoid having substantial quantities of the iron oxide removed with the gangue. The addition of the polymer or copolymer also aids in allowing the starch flocculant to more selectively flocculate the iron component.

The foregoing process is best observed by realizing that the gangue and iron components are all in a colloidal suspension. Moreover, the gangue makes up about one half to two thirds of the solids in deslime thickener. Thus, anything which aids in minimizing carry over of the iron to the overflow, or conversely maximizing the selectivity of the flocculant in the deslime thickener will substantially increase the recovery and grade of the iron oxide obtained from the underflow of the deslime thickener.

When the primary ore recovered from the deslime thickener is magnetite, the following step after the deslime thickener will be through a magnetic separator and/or flotation separation to enhance grade and recovery. A magnetic separator is a large permanent magnet which allows recovery of the magnetic ore in substantial quantity. Of course, where a hematite ore is employed, there is no reason to employ a magnetic separator as that ore is not magnetic. It is however possible, where the ore bodies are mixed magnetite and hematite, to make a determination on the use of a magnetic separator depending on the degree of recovery of magnetite which is desired.

In the case of hematite, the deslime thickener underflow is directed to a flotation feed conditioner and distributor where a frothing agent such as 2-ethylhexanol, a starch depressant and an amine collector is added. The purpose of the starch depressant is to flocculate the iron oxide. The resultant slurry is further processed through a rougher and cleaner flotation step which further floats out gangue which was not separated in the deslime thickener. The mechanism of gangue removal in floatation is the collection of gangue particles on the air bubbles which are formed by passing air into the flot cell.

Following rougher and cleaner floatation, polymer flocculants are added. The concentrate thickener, through the use of a polymer flocculant allows the further concentration of the iron oxides. The alkalinity is reduced through the addition of carbon dioxide which may cause the formation of interfering carbonate salts.

The addition of surfactants, followed by a further addition of a polymer flocculant through a distributor and ultimately through a filter dewaters the iron oxide concentrate for balling and pelletizing.

As the materials added to the present invention differ little from other liquid components used in mining and ore recovery, it is possible to add the dispersant polymer through existing equipment. As the mine operation utilizes caustic, sodium silicate, glassy phosphates, flocculants, collectors (typically amines) and surfactants, there will be existing equipment to add the dispersant polymer in place of one of the foregoing components. As the dispersant polymers are free flowing liquid materials, little or no mixing is required to add the dispersant polymer to the ferrous ore at the primary autogenous mill (grinding step).

While the present invention has described the dispersant polymer as being added at the primary autogenous mill, it is possible to add the dispersant polymer at any point in the process where enhanced dispersion is needed. The dispersant polymer may be added at one or more prior steps to insure that the dispersant polymer is adequately dispersed in the deslime thickener and flotation cells. Stated otherwise, adding the dispersant polymer directly to the deslime thickener may result in substantial losses of the dispersant polymer. Thus, to avoid overflow losses of the dispersant polymer, such is added far enough back in the concentrator process to ensure that thorough mixing occurs.

The acrylic acid polymers useful herein generally as the homopolymer have the structural formula $(C_3H_4O_2)_x.xNa$ where x is an integer. The salt may be used or the acid with in situ neutralization in the ore processing. The polymers typically have molecular weights of 1000 to 10,000 preferably 2,000 to 9,000 and most preferably 3,000 to 6,000.

The dispersant polymers that are particularly useful in the present invention are homopolymers or copolymers of acrylic acid. The dispersant polymers which may be utilized herein include Mayosperse 502A. Mayosperse 502A is available from the Mayo Chemical Company. The Mayosperse 502A is a polyacrylic acid in the form of a sodium salt which is partially neutralized to a pH of 3.0–3.5.

The Mayosperse 502A is a clear-colored liquid have a faint acrylic acid odor. The boiling point of the Mayosperse 502A is 100° C., and its freezing point is −20° C. As the viscosity of the Mayosperse 502A at 25° C. is 100–300 cps, it is relatively non-viscous and is easily solubilized in water. The specific gravity of the Mayosperse 502A is 1.22 to 1.23.

A further polymer useful herein is Mayosperse 454N. The Mayosperse 454N is a mixture of a sodium polyacrylate and the polyacrylic acid. Mayosperse 454N is available as a 45% by weight aqueous solution having a thermal stability of greater than 250° C., and a freezing point of −20° C. The specific gravity at 25° C. is 1.3–1.33 and the product density is 11.0 pounds per gallon.

Further physical parameters to Mayosperse 454N are a viscosity of 500 cps at 25° C. and the pH at that temperature is 7.0 to 7.5. The molecular weight of Mayosperse 454N is 4500.

A further useful dispersant polymer herein is Mayosperse 453 AN. The Mayosperse 453 AN is a clear straw colored liquid available as a 45% solid solution. The thermal stability of the Mayosperse 453 AN is created at 250° C. and has a freezing point of −20° C. The specific gravity of the Mayosperse 453 AN at 25° C. is 1.27 and the product is available in a density of 10.6 pounds per gallon. A further physical parameter of the Mayosperse 453 AN is that its viscosity at 25° C. is 150–350 cps.

The Mayosperse 453 AN is available as the sodium salt and as a pH of 5 to 5.5 at 25° C. The molecular weight of Mayosperse 453 AN is 3300. The Mayosperse 453 AN is a 70% neutralized mixture, e.g, 70% of the acrylic acid functionality on the molecule is neutralized.

A polymer useful herein is Mayosperse 452 AN. The Mayosperse 452 AN is a 70% sodium neutralized salt of polyacrylic acid having a pH of 5.0 to 5.5. Mayosperse 452 AN is described as a cleaning compound. The Mayosperse 452 AN is available as a clear-straw colored liquid having a boiling point of 100° C. and a freezing point of −20° C. The viscosity at 25° C. of the Mayosperse 452 AN is 150–250 cps. Mayosperse 452N, as its counterpart product, is fully soluble in water and has a specific gravity at 25° C. of 1.26–1.28.

A further useful dispersant polymer in the present invention is Mayosperse 432N. The Mayosperse 432N is a sodium polyacrylate, polyacrylic acid sodium salt mixture. Mayosperse 432N is available as a 40–43% solids composition in water. Mayosperse 432N as Mayosperse 452 AN is suggested as a cleaning compound.

The physical parameters of the Mayosperse 432N include being a clear-straw colored to light amber liquid with a slight acrylic odor. The boiling point of Mayosperse 432N is 100° C. and the freezing point is −20° C. The viscosity at 25° C. of the Mayosperse 432N is 150 to 350 cps, and the product is completely soluble in water. The specific gravity at 25° C. is 1.30–1.31.

Mayosperse 433N is a further useful polymer in the present invention. The Mayosperse 433N is described as being a clear, straw-colored to light amber liquid with a slight acrylic odor. Mayosperse 433N is available as a 40–43% solid product which is described as a sodium polyacrylate, polyacrylic acid, sodium salt mixture. The Mayosperse 433N has a freezing point of −20° C., and thermal stability of greater than 250° C. The Mayosperse 433N has a specific gravity at 25° C., of 1.3–1.31, and is available at 10.9 pounds per gallon (1.27 kg/l). The molecular weight of the Mayosperse 433N is 3300. At 25° C., the Mayosperse 433N has a viscosity at 150–350 cps, and the pH is 7.0 to 7.5. Mayosperse 433N is described as a cleaning compound.

Mayosperse A-28 is aqueous solution of the ammonium salt analogous to other Mayosperse products. Mayosperse A-28 is suggested for use in applications that are sensitive to high electrolyte content as well as in the ceramics industry, or in applications that require low sodium or low ash content. The Mayosperse A-28 is a low molecular weight polyacrylate available as a clear, pale yellow liquid. Mayosperse A-28 exhibits a faint ammonia odor and is available at 28.0% solids. At 25° C. the specific gravity of the Mayosperse A-28 is 1.115 and the pH of a 1% aqueous solution at 25° C. is 7.0–7.5.

The viscosity at 25° C. is 500–700 cps for the Mayosperse A-28. Mayosperse is very soluble in aqueous systems and exhibits a freeze point of −29° C., and thermal stability of greater than 260° C.

Another polymer useful herein is Benesperse PA15 polyacrylate is a fully neutralized polyacrylate obtained with excess caustic. Benesperse PA15 is available from the Glenn Corporation of St. Paul, Minn. Benesperse PA 45N and Benesperse PA 33N are also useful polymers for use herein.

Benesperse PA 45N is available at 45% solids and has a freezing point of minus 20 Celsius and thermal stability of greater than 250 degrees Celsius. This polymer has a density of 11 pounds per gallon (about 1.3 kg/l). The viscosity is 500 cps at 25 degrees Celsius and the pH at the same temperature is 7.0 to 7.5. The molecular weight of Benesperse PA 45N is 4,500.

Benesperse PA 33N is available at 40–43% solids and has a freezing point of minus 20 Celsius and thermal stability of greater than 250 degrees Celsius. This polymer has a density of 10.9 pounds per gallon (about 1.27 kg/l). The viscosity is 500 cps at 25 degrees Celsius and the pH at the same temperature is 7.0 to 7.5. The molecular weight of Benesperse PA 33N is 3,300.

The polymers used herein may conveniently be mixtures of homopolymers, mixtures of copolymers, or mixtures of copolymers and homopolymers. Copolymers may be those containing acrylate and methacrylate functionality. It is to be understood that the acid refers to the salt and that the salt refers to the acid when describing the polymers. The foregoing is true because the salt and the acid are interchangeable depending on the pH or the surrounding medium.

The following is a suggested exemplification of the present invention.

EXAMPLE

A trial run using an acrylate polymer to enhance recovery of iron ore is conducted on the deslime thickener at the Tilden Michigan mine. The acrylic polymer is used at various concentrations at 0.5 to 20 pounds of polymer per long ton of crude ore (about 0.25 kg to 10 kg per 1,000 kilograms) depending on the pH of the ore pulp and the desired degree of recovery versus the purity of the ore. The deslime thickener temperature is typically 40° to 90° F. (5° to 30° C). Enhanced recovery of the ore of from 1 to 10% is obtained. Grade (purity) is similarly improved.

What is claimed is:

1. A process for treating an aqueous iron containing ore slurry comprising a source of iron oxide and gangue including the steps of contacting the iron containing ore slurry with an effective amount of a dispersant polymer or copolymer containing at least one acrylic functional group having a molecular weight of 1,000 to less than about 10,000, and grinding the dispersant and iron containing ore slurry to a desired particle size and thereafter adding a selective flocculant for the iron oxide to the ground ore slurry and subjecting the flocculant containing ground ore slurry having said dispersant and iron oxide therein to a settling or decanting separating step to cause the iron oxide to settle and the gangue is decanted and removed as overflow.

2. The method of claim 1 wherein the iron oxide in the iron containing component is obtained from hematite.

3. The method of claim 1 wherein the Ph of the aqueous iron containing ore slurry is from 8 to 10.5.

4. The method of claim 1 wherein the molecular weight of the dispersant is 2,000 to 9,000.

5. The method of claim 1 wherein the aqueous iron containing ore slurry has iron oxide particles sized to a range of about 0.1 to about 500 microns.

6. The method of claim 1 wherein the acrylic functional group is an acrylic acid group.

7. The method of claim 1 wherein the ore is taconite.

8. The method of claim 1 wherein the dispersant is added at about 0.25 to about 10 kilograms per 1,000 kilograms of the iron containing ore.

9. The method of claim 1 wherein the separation is conducted at a temperature of about 5 degrees C. to about 30 degrees C.

10. The method of claim 1 wherein the dispersant is a homopolymer.

11. The method of claim 1 wherein the dispersant is a copolymer.

12. The method of claim 1 wherein the dispersant is a copolymer of acrylic acid and methacrylic acid.

13. The method of claim 1 wherein water employed is at the ambient pH of a source water used to make the aqueous slurry.

14. The method of claim 1 wherein of the dispersant is a mixture of homopolymers and copolymers.

15. A method for separating an iron containing component from a silicate component including the steps of forming an aqueous mixture of the iron containing component and the silicate component, adding thereto an effective amount of a dispersant polymer or copolymer containing an acrylic functional group having a molecular weight of 1,000 to less than about 10,000, and a selective flocculant for the iron containing component; and subjecting the flocculant and dispersant containing aqueous mixture to a settling or decanting separation step to cause the iron containing component to settle and be removed in an underflow and the silicate component is decanted and removed as a overflow.

16. The method of claim 15 wherein the iron containing component is hematite.

17. The method of claim 15 wherein the pH of the aqueous mixture is from 8 to 10.5.

18. The method of claim 15 wherein the molecular weight of the dispersant is 2,000 to 9,000.

19. The method of claim 15 wherein the iron containing component and the silicate component are sized to a range of about 1 to about 100 microns prior to separating the silicate component.

20. The method of claim 15 wherein the acrylic functional group is an acrylic acid group.

21. The method of claim 15 wherein the mixture of the iron containing component and the silicate component are obtained as taconite.

22. The method of claim 15 wherein the flocculant is a starch compound.

23. The method of claim 15 wherein the dispersant is added at about 0.25 to about 10 kilograms per 1,000 kilograms of the combined weight of the iron containing component and the silicate component.

24. The method of claim 15 wherein the separation is conducted at a temperature of about 5 degrees C. to about 30 degrees C.

25. The method of claim 15 wherein the dispersant is a homopolymer.

26. The method of claim 15 wherein the dispersant is a copolymer.

27. The method of claim 15 wherein the dispersant is a copolymer of acrylic acid and methacrylic acid.

28. The method of claim 15 wherein water employed is at the ambient pH of a source water used to make the aqueous mixture.

29. The method of claim 15 wherein the aqueous mixture is sized prior to the settling or decanting step and the dispersant is added to the mixture of the iron containing component and the silicate component prior to sizing.

30. The method of claim 15 wherein the molecular weight of the dispersant is 3,000 to 6,000.

31. A method for separating an iron containing component from a phosphorous component including the steps of forming an aqueous mixture of the iron containing component and the phosphorous component, adding thereto an effective amount of a dispersant polymer or copolymer containing an acrylic functional group having a molecular weight of 1,000 to less than about 10,000 and a flocculant for the iron containing component, and subjecting the flocculant and dispersant containing aqueous mixture to a settling or decanting separation step to cause the iron containing component to settle and be removed in an underflow and the phosphorous component is decanted and removed as an overflow.

32. The method of claim 31 wherein the iron containing component is hermatite.

33. The method of claim 31 wherein the pH of the aqueous mixture is from 8 to 10.5.

34. The method of claim 31 wherein the molecular weight of the dispersant is 2,000 to 9,000.

35. The method of claim 31 wherein the iron containing component and the phosphorous component are sized to a range of about 1 to about 100 microns prior to separating the phosphorous component.

36. The method of claim 31 wherein the acrylic functional group is an acrylic acid group.

37. The method of claim 31 wherein the mixture of the iron containing component and the phosphorous component are obtained as taconite.

38. The method of claim 31 wherein the flocculant is starch.

39. The method of claim 31 wherein the dispersant is added at about 0.25 to about 10 kilograms per 1,000 kilograms of the combined weight of the iron containing component and the phosphorous component.

40. The method of claim 31 wherein the separation is conducted at a temperature of about 5 degrees C. to about 30 degrees C.

41. The method of claim 31 wherein the dispersant is a homopolymer.

42. The method of claim 31 wherein the dispersant is a copolymer.

43. The method of claim 31 wherein the dispersant is a copolymer of acrylic acid and methacrylic.

44. The method of claim 31 wherein the water is at the ambient pH of a source water used to make the aqueous mixture.

45. The method of claim 31 wherein the dispersant is added to the mixture of the iron containing component and the phosphorous component prior to a sizing.

46. The method of claim 31 wherein the molecular weight of the dispersant is 3,000 to 6,000.

47. A method for separating hematite from a member selected from the group consisting of a silicate component and a phosphorous containing component including the steps of grinding a taconite ore in the presence of water to obtain an aqueous mixture of hematite adding thereto an effective amount of a dispersant polymer or copolymer containing an acrylic functional group having a molecular weight of 1,000 to less than 10,000 and a flocculant for the hematite, and subjecting the flocculant and dispersant containing aqueous mixture to a settling or decanting separation step to cause the hematite to settle and be removed in an underflow and the silicate component is decanted and removed as an overflow.

48. The method of claim 47, wherein the pH of the aqueous mixture is from 8 to 10.5.

49. The method of claim 47 wherein the molecular weight of the dispersant is 2,000 to 9,000.

50. The method of claim 47 wherein the taconite and the silicate component are sized to a range of about 1 to about 100 microns prior to separating the silicate component.

51. The method of claim 47 wherein the acrylic functional group is an acrylic acid group.

52. The method of claim 47 wherein the flocculant is starch.

53. The method of claim 47 wherein the dispersant is added at about 0.25 to about 10 kilograms per 1,000 kilograms of the taconite ore.

54. The method of claim 47 wherein the separation is conducted at a temperature of about 5 degrees C. to about 30 degrees C.

55. The method of claim 47 wherein the dispersant is a homopolymer.

56. The method of claim 47 wherein the dispersant is a copolymer.

57. The method of claim 47 wherein the dispersant is a copolymer of acrylic acid and methacrylic acid.

58. The method of claim 47 wherein water employed is at the ambient pH of a source water used to make the aqueous mixture.

59. The method of claim 47 wherein the dispersant is added to the aqueous mixture prior to a sizing.

60. The method of claim 47 wherein the molecular weight of the dispersant is 3,000 to 6,000.

* * * * *